US011246441B2

(12) United States Patent
Clark et al.

(10) Patent No.: US 11,246,441 B2
(45) Date of Patent: Feb. 15, 2022

(54) HANGER WITH SECUREMENT ELEMENT

(71) Applicant: TARGET BRANDS, INC., Minneapolis, MN (US)

(72) Inventors: Jeremy A. Clark, Minneapolis, MN (US); Timothy James Martell, Minneapolis, MN (US); Richard P. Riedel, Blaine, MN (US); Terrence J. Hornsby, Jr., Minneapolis, MN (US)

(73) Assignee: TARGET BRANDS, INC., Minneapolis, MN (US)

( * ) Notice: Subject to any disclaimer, the term of this patent is extended or adjusted under 35 U.S.C. 154(b) by 95 days.

(21) Appl. No.: 16/723,775

(22) Filed: Dec. 20, 2019

(65) Prior Publication Data

US 2020/0121107 A1 Apr. 23, 2020

Related U.S. Application Data

(63) Continuation of application No. 15/977,779, filed on May 11, 2018, now Pat. No. 10,631,677.

(Continued)

(51) Int. Cl.
*A47G 25/40* (2006.01)
*A47G 25/30* (2006.01)

(Continued)

(52) U.S. Cl.
CPC ..... *A47G 25/48* (2013.01); *A47G 25/1421* (2013.01); *A47G 25/30* (2013.01);

(Continued)

(58) Field of Classification Search
CPC ..... A47G 25/00–74; A47G 25/1421; A47G 25/481–488
See application file for complete search history.

(56) References Cited

U.S. PATENT DOCUMENTS 890,023 A 6/1908 Cazier et al.
1,754,940 A * 4/1930 Freeman ..... A47G 25/746 206/293

(Continued)

FOREIGN PATENT DOCUMENTS

WO WO 2011026433 A1 * 3/2011

OTHER PUBLICATIONS

"Velvet Flocked Hanger", printed from www.dhgate.com/product/flocked-hanger-with-good-quality-druable/138480211.html, publicly available at least as early as Jan. 18, 2017 (3 pages).

*Primary Examiner* — Ismael Izaguirre
(74) *Attorney, Agent, or Firm* — JoAnn M. Seaton; Griffiths & Seaton PLLC

(57) ABSTRACT

A garment hanger includes a hook and an arm. The hook is configured to receive a support rod, and the arm is coupled to the hook and extends outwardly to a free arm end. The arm includes a first substantially planar panel and a top panel extending rearwardly from a top edge of the first substantially planar panel. The arm further includes an indentation and a finger. The indentation is defined adjacent the first substantially planar panel to be at least partially open in a direction facing away from the first substantially planar panel. The indentation defines an outermost edge nearest the free arm end and an innermost end nearest the hook. The finger extends from one of the outermost edge and the innermost edge of the indentation toward the other and is configured to hold a portion of a garment within the indentation.

19 Claims, 13 Drawing Sheets

Related U.S. Application Data

(60) Provisional application No. 62/505,301, filed on May 12, 2017.

(51) Int. Cl.
*A47G 25/48* (2006.01)
*A47G 25/14* (2006.01)

(52) U.S. Cl.
CPC ..... *A47G 25/482* (2013.01); *A47G 25/483* (2013.01); *A47G 25/485* (2013.01)

(56) References Cited

U.S. PATENT DOCUMENTS 2,171,680 A 9/1939 Baugh
2,419,723 A 4/1947 Mack, Sr.
2,426,292 A 8/1947 Appleman
2,428,240 A 9/1947 Pierce
2,516,297 A 7/1950 Burpee
2,553,710 A * 5/1951 Incampo ..... A47G 25/74 211/85.3
2,577,940 A 12/1951 Webster
2,656,077 A 10/1953 Gensky et al.
2,723,787 A 11/1955 Bransdorf
2,793,762 A * 5/1957 Broussard ..... D06F 57/00 211/113
2,843,297 A 7/1958 Jennette
2,846,128 A * 8/1958 Fuller ..... A47G 25/743 223/91
3,085,724 A 4/1963 Wilde
3,559,852 A 2/1971 Green
3,731,857 A 5/1973 Haggar
4,623,079 A 11/1986 Tendrup et al.
4,828,155 A 5/1989 Louw
D302,214 S 7/1989 Wilson
D303,325 S 9/1989 Marshall
5,040,686 A 8/1991 Morrow
5,065,916 A 11/1991 Fildan
5,071,045 A 12/1991 Hollis
5,074,445 A 12/1991 Chen
5,083,691 A 1/1992 Handrick
5,129,557 A 7/1992 Kolton et al.
5,236,109 A 8/1993 Zuckerman
5,361,949 A 11/1994 Petrou
5,573,151 A 11/1996 Fildan
5,632,423 A 5/1997 Louw
5,806,728 A 9/1998 Forsstrom et al.
6,019,261 A 2/2000 Morgan et al.
6,050,461 A 4/2000 Batts et al.
6,065,652 A 5/2000 Dooling-Sherman
D426,389 S * 6/2000 Dooling ..... A47G 25/74 D6/318
6,079,598 A 6/2000 Tsai
6,105,836 A 8/2000 Batts et al.
6,142,347 A 11/2000 Kolton et al.
6,158,635 A 12/2000 Batts
6,173,872 B1 1/2001 Cohen
6,250,523 B1 6/2001 Louw
6,338,426 B1 1/2002 Okiyama
6,357,638 B2 3/2002 Gouldson
6,457,615 B1 10/2002 Lam
6,467,658 B1 10/2002 Olk et al.
6,467,659 B2 10/2002 Gouldson
6,499,634 B2 12/2002 Olk et al.
6,516,980 B1 2/2003 Goldman
6,588,634 B2 7/2003 Gouldson et al.
6,688,503 B2 2/2004 Viazanko et al.
6,715,650 B2 4/2004 Gouldson
D500,412 S 1/2005 Gouldson
6,892,910 B2 5/2005 Capuano et al.
D507,419 S 7/2005 Gouldson
7,156,271 B2 1/2007 Louw
7,455,203 B2 11/2008 Gouldson et al.
D606,764 S 12/2009 Warren
D606,765 S 12/2009 Warren
D606,766 S 12/2009 Warren
D606,767 S 12/2009 Warren
D607,217 S 1/2010 Warren
7,753,241 B2 7/2010 Masanek, Jr.
D628,818 S 12/2010 Warren
D628,820 S 12/2010 Warren
D628,821 S 12/2010 Warren
D628,822 S 12/2010 Warren
7,896,204 B2 3/2011 Gouldson
7,938,300 B2 5/2011 Diamond et al.
7,980,434 B2 7/2011 Gouldson
D655,924 S 3/2012 Gouldson
8,302,826 B2 11/2012 Gouldson
D711,659 S 8/2014 Gouldson
8,991,666 B2 3/2015 Mazyck
9,027,804 B2 5/2015 Barre et al.
9,282,839 B2 3/2016 Rakhamimov et al.
9,386,873 B2 7/2016 Gouldson
10,631,677 B2 * 4/2020 Clark ..... A47G 25/1421
2001/0015361 A1 8/2001 Gouldson
2001/0016994 A1 8/2001 Gouldson et al.
2002/0108975 A1 8/2002 Hunt et al.
2002/0113100 A1 8/2002 Gouldson
2003/0015558 A1 1/2003 Gouldson et al.
2004/0173646 A1 9/2004 Louw
2004/0256425 A1 12/2004 Barre et al.
2005/0067447 A1 3/2005 Louw
2008/0296324 A1 12/2008 Zhao et al.
2009/0045232 A1 2/2009 Gray
2009/0078726 A1 3/2009 Boulet et al.
2010/0019005 A1 1/2010 Gouldson
2010/0025440 A1 2/2010 Gouldson
2011/0057001 A1 3/2011 Louw
2011/0220690 A1 * 9/2011 Hale ..... A47G 25/1442 223/85
2011/0284597 A1 11/2011 Kaleta et al.

* cited by examiner

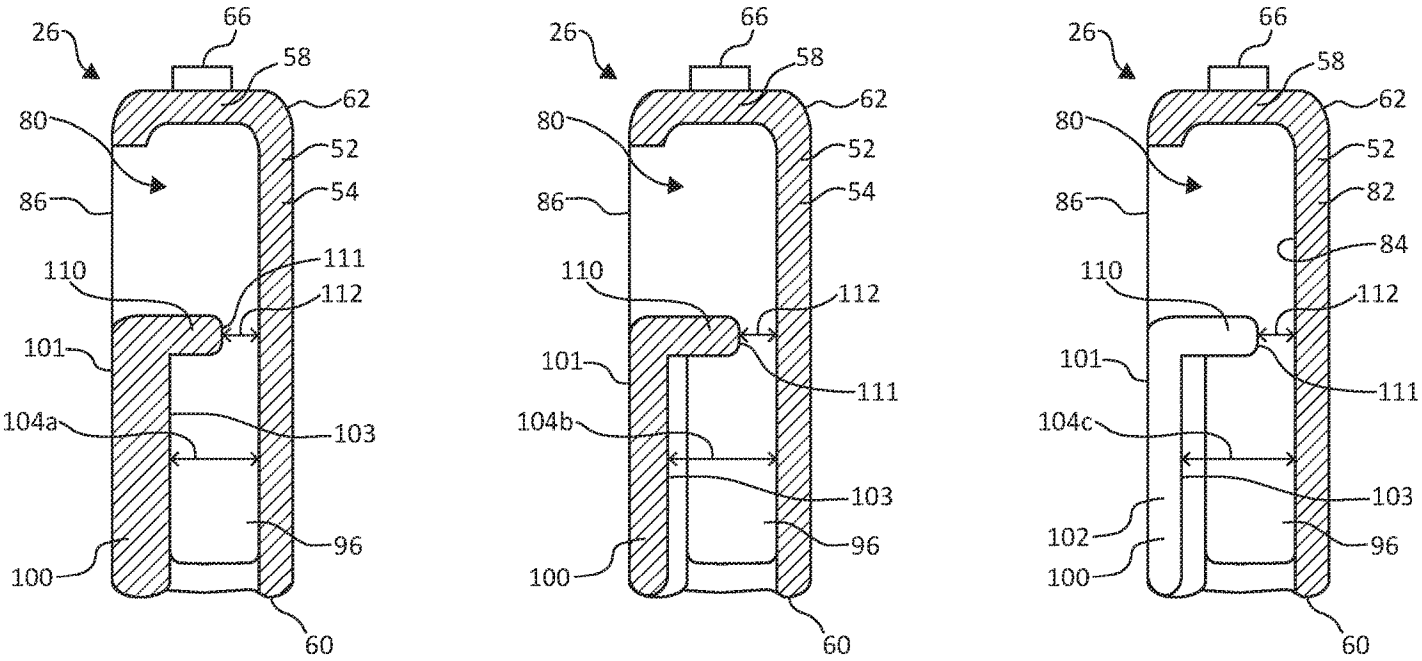
FIG. 13
FIG. 14
FIG. 15
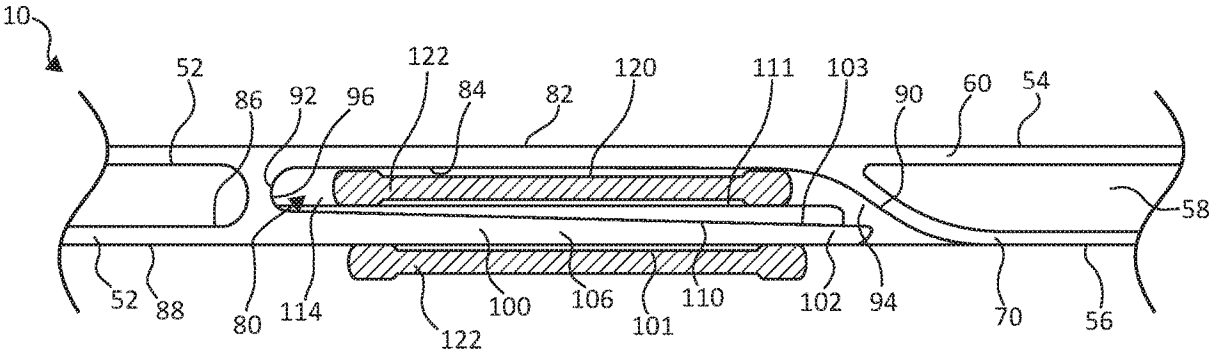
FIG. 16

HANGER WITH SECUREMENT ELEMENT

CROSS-REFERENCE TO RELATED APPLICATION

This application is a continuation application and claims priority under 35 U.S.C. § 120 to U.S. patent application Ser. No. 15/977,779, filed on May 11, 2018, which is a non-provisional application of and claims priority under 35 U.S.C. § 119 to U.S. Provisional Patent Application No. 62/505,301, filed May 12, 2017, both of which are incorporated herein by reference.

BACKGROUND OF THE INVENTION

Hangers are often used to support clothing and other garments for storage and display of the garments in retail stores as well as for storage in a consumer's home following purchase. Such hangers with garments are typically hung from a support rod along with a plurality of other hangers supporting other similar garments and/or garments of various shapes and sizes. The different sizes and configuration of garments and their movement relative to the hanger and/or movement of the hanger relative to the support rod often times causes the garments to slip down along the arms of the corresponding hanger and/or to fall off of the hanger at least partially. For example, garments with small shoulder straps and/or wide neck openings are particularly susceptible to falling off of hangers. Conventional hangers attempt to affix the garments more securely to hangers by providing clip or hook members extending from top or bottom surfaces of the arms.

SUMMARY

One embodiment of the present invention relates to a garment hanger including a hook and an arm. The hook is configured to selectively receive a support rod, and the arm is coupled to the hook and extends outwardly to a free arm end. The arm includes a first substantially planar panel facing toward one of a front and a rear of the garment hanger and a top panel extending rearwardly from a top edge of the first substantially planar panel. The arm further includes an indentation and a finger. The indentation is defined adjacent the first substantially planar panel and below the top panel in a manner at least partially open in a direction facing away from the first substantially planar panel. The indentation defines an outermost edge nearest the free arm end and an innermost end nearest the hook. The finger extends from one of the outermost edge and the innermost edge of the indentation toward the other one of the outermost edge and the innermost edge of the indentation and is configured to hold a portion of a garment within the indentation. Other hangers, securement elements, and associated methods are also described herein.

BRIEF DESCRIPTION OF THE DRAWINGS

Embodiments of the invention will be described with respect to the figures, in which like reference numerals denote like elements, and in which:

FIG. 13 is a cross-sectional view illustration taken along the line X-X in FIG. 11, according to one embodiment of the present invention.

FIG. 14 is a cross-sectional view illustration taken along the line Y-Y in FIG. 11, according to one embodiment of the present invention.

FIG. 15 is a cross-sectional view illustration taken along the line Z-Z in FIG. 11, according to one embodiment of the present invention.

FIG. 16 is a cross-sectional view illustration taken along the line W-W in FIG. 10, according to one embodiment of the present invention.

DETAILED DESCRIPTION

The following detailed description of the invention provides example embodiments and is not intended to limit the invention or the application and uses of the invention. Furthermore, there is no intention to be bound by any theory presented in the preceding background of the invention or the following detailed description of the invention. Relational terms herein such a first, second, top, bottom, etc. may be used herein solely to distinguish one entity or action from another without necessarily requiring or implying an actual such relationship or order. In addition, as used herein, the term "about" or "substantially" apply to all numeric values or descriptive terms, respectively, and generally indicate a range of numbers or characteristics that one of skill in the art would consider equivalent to the recited values or terms, that is, having the same function or results.

This innovation provides a hanger, such as a garment hanger, having one or more integrated securement elements to facilitate maintaining garments on the hanger. In one embodiment, the hanger includes one or more arms having a front-facing surface and an opposite, rear-facing surface. The arm defines an indentation or recess extending from one of the front-facing surface and the rear-facing surface toward the other. A finger or cantilevered protrusion element extends from one side of the indentation toward, but not to, the other side of the indentation. In this manner, the finger is spaced from a rear of the indentation forming a slot for receiving a portion of a garment in a manner configured to hold the garment to the hanger. The securement element is formed on one of the front-facing or rear-facing surfaces provides an aesthetic appeal, as the finger does not distract from the overall aesthetic form of the hanger. The securement element is formed on one of the front-facing or rear-facing surfaces also provides functional advantages by allowing the garment to separately, yet, in one embodiment, more tightly, interact with top surfaces of the hanger and protecting against inadvertent release of garment from the securement element. Other advantages and features are further described below.

Figure 1:
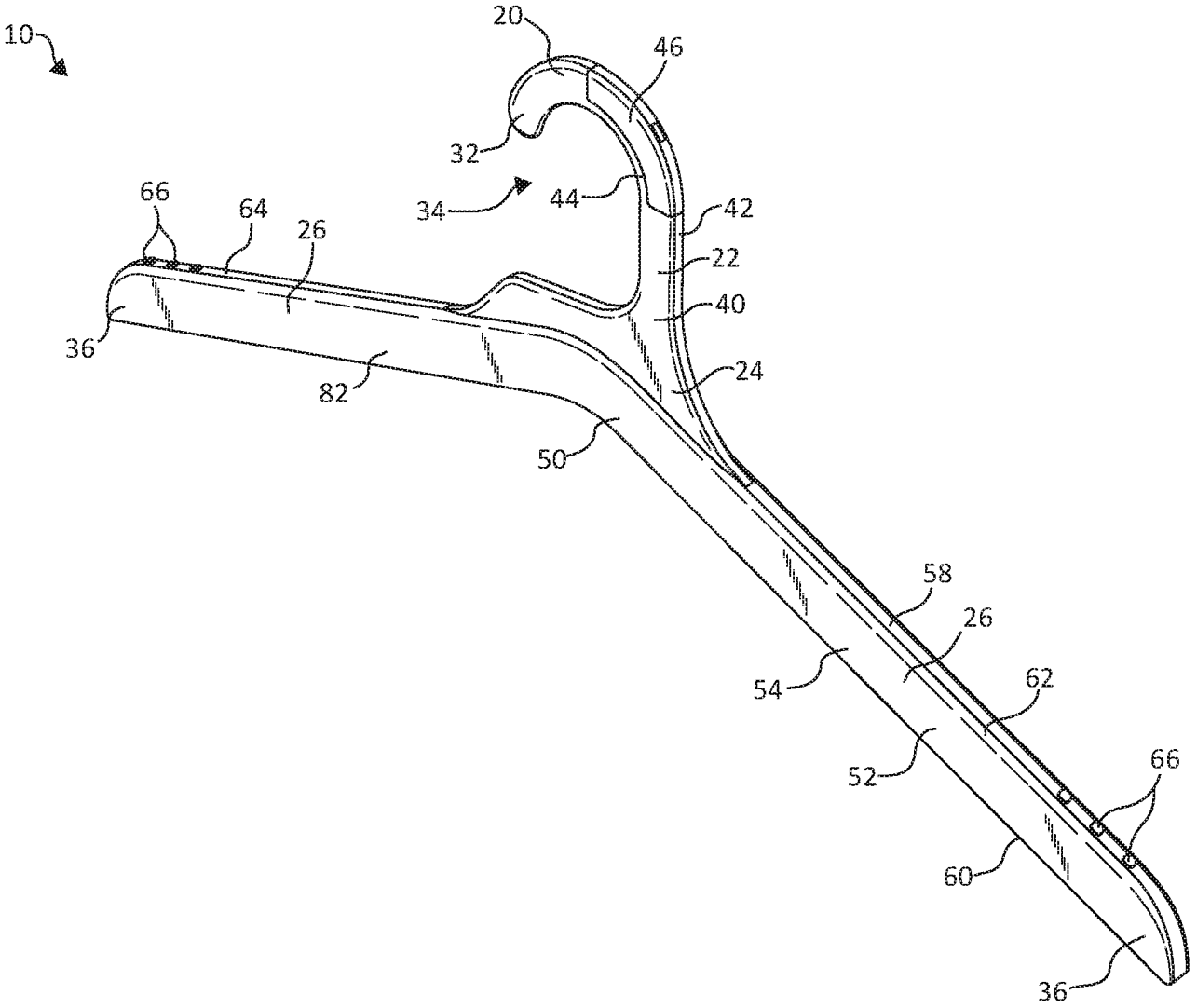
FIG. 1 is a front perspective view illustration of hanger, according to one embodiment of the present invention.
Figure 9:
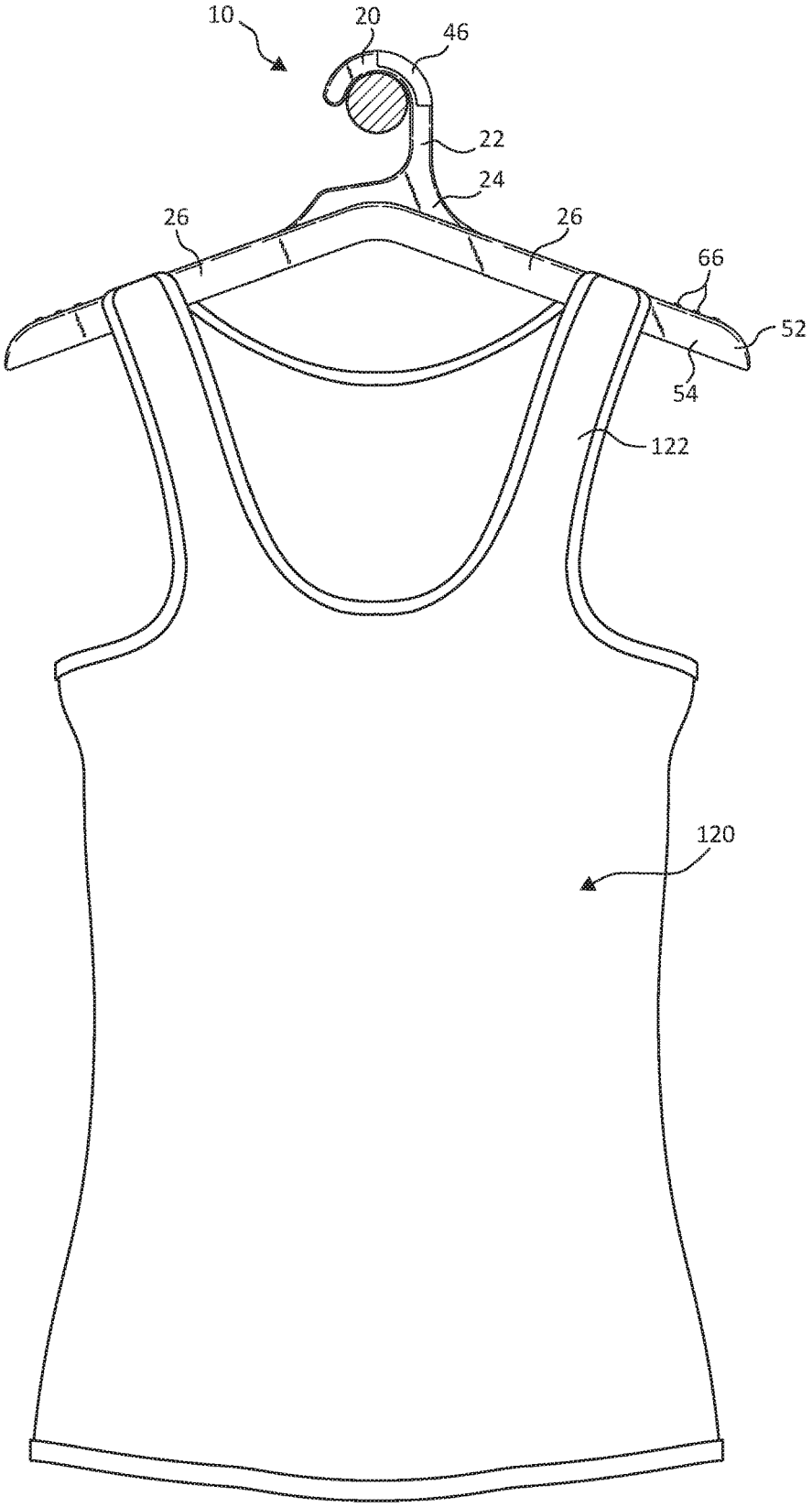
FIG. 9 is a front perspective view illustration of the hanger of FIG. 1 with a garment, accordingly to one embodiment of the present invention.
Figure 17:
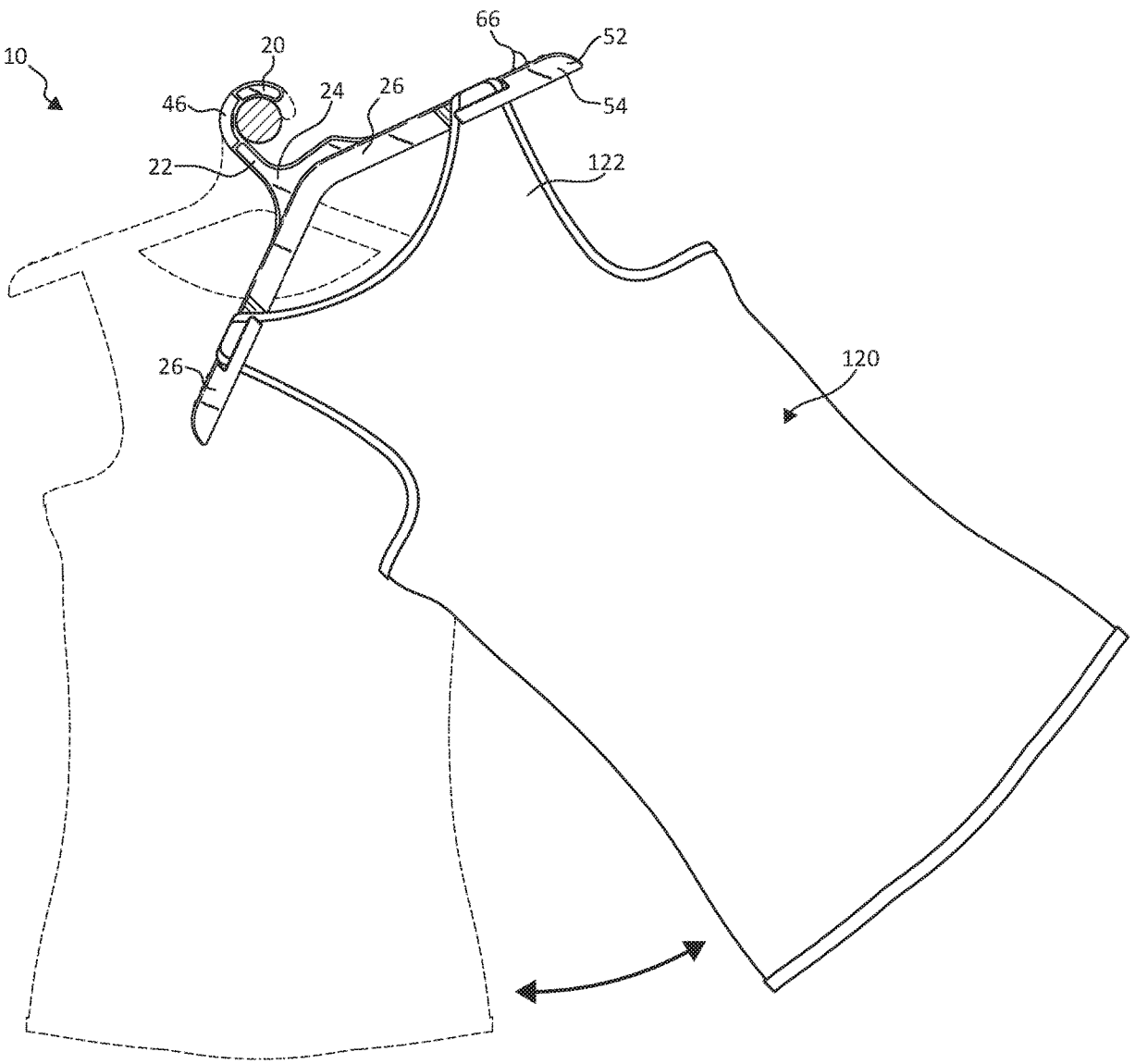
FIG. 17 is a is a rear perspective view illustration of the hanger and garment of FIG. 9 tilted relative to a support rod, according to one embodiment of the present invention.
Figure 18:
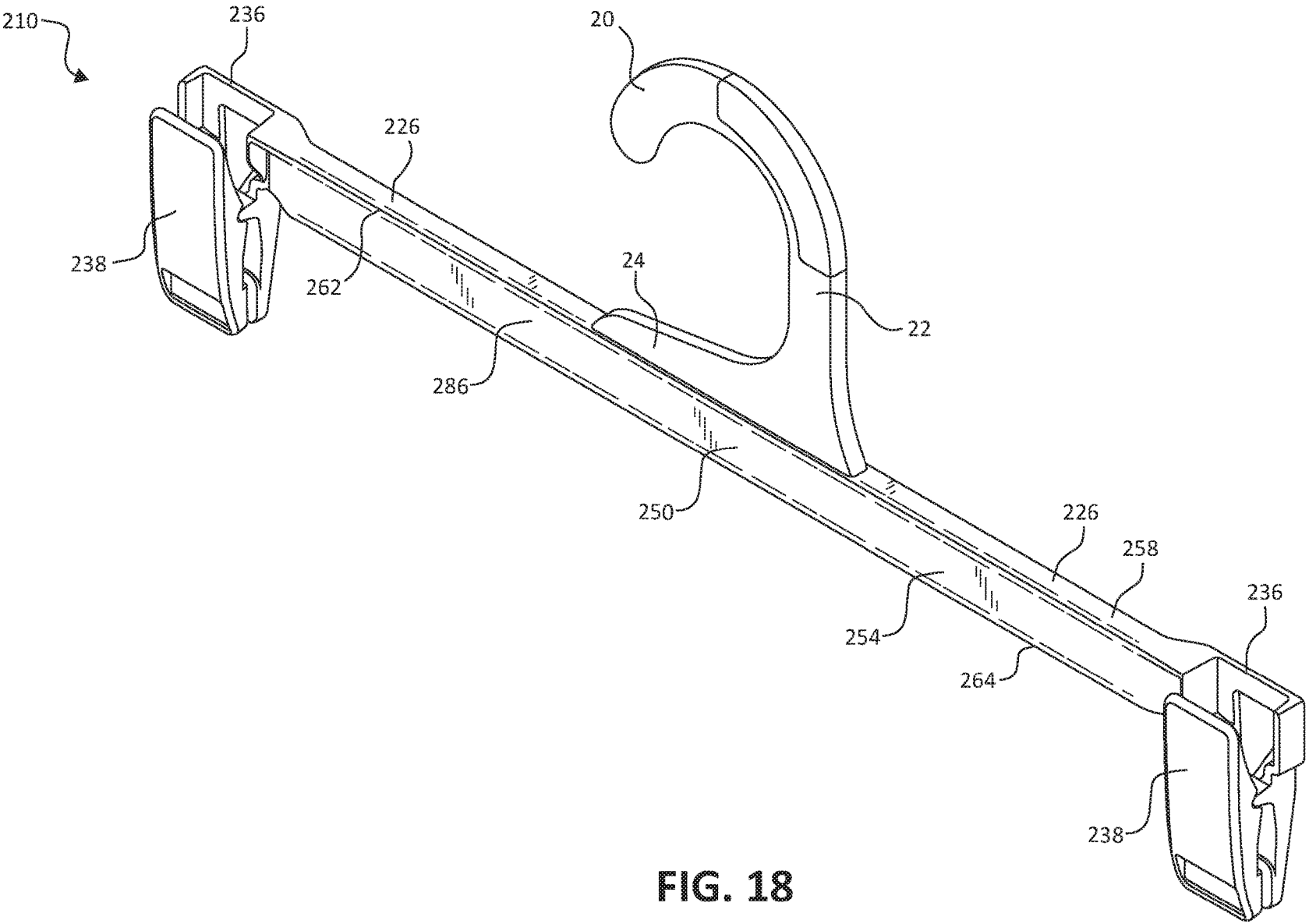
FIG. 18 is a front perspective view illustration of a hanger, according to one embodiment of the present invention.
Figure 19:
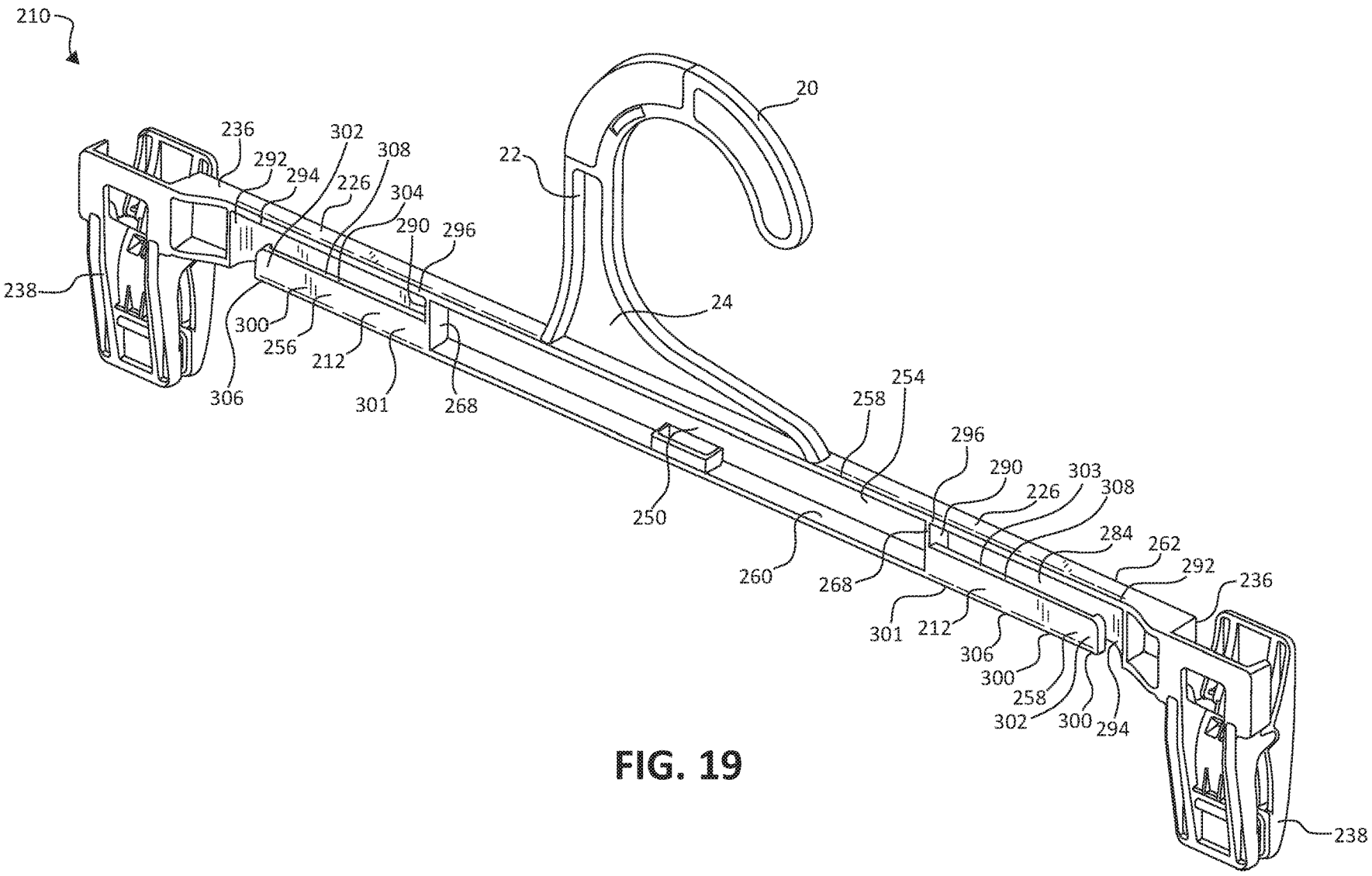
FIG. 19 is a rear perspective view illustration of the hanger of FIG. 18, according to one embodiment of the present invention.
Figure 20:
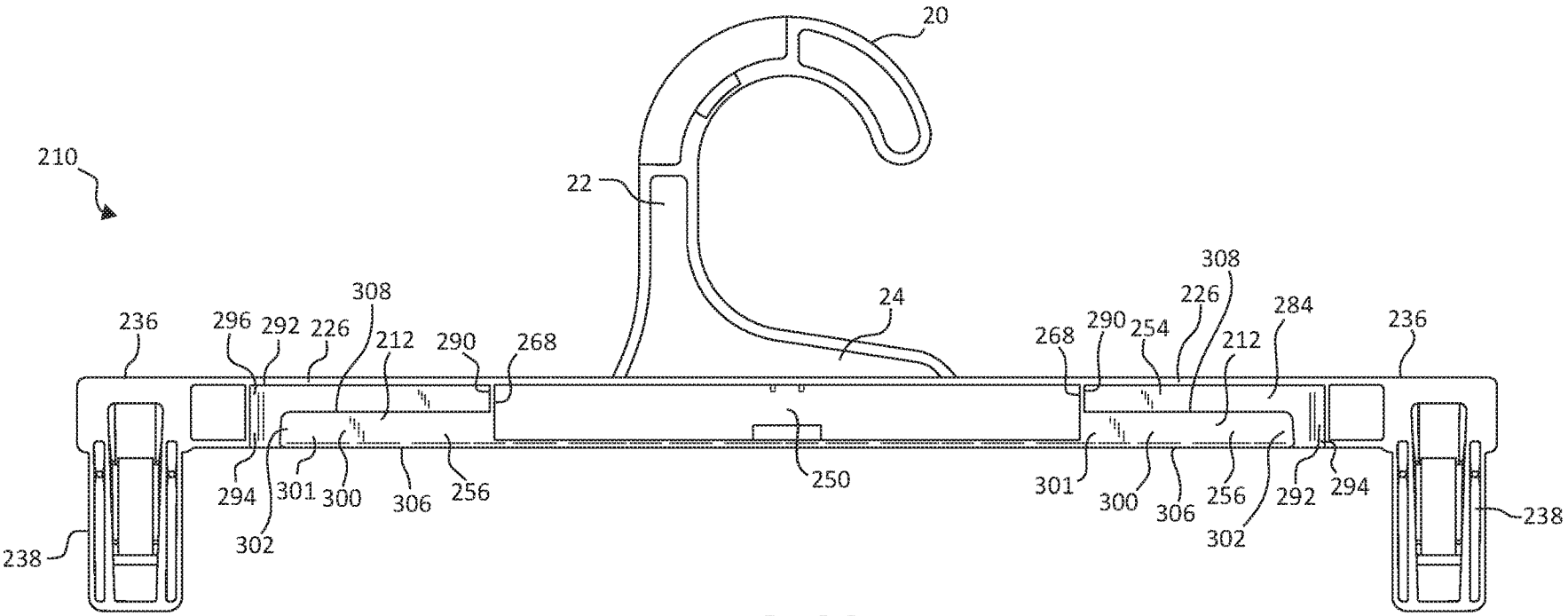
FIG. 20 is a rear-view illustration of the hanger of FIG. 18, according to one embodiment of the present invention.

Turning to the Figures, FIG. 1 illustrates a hanger 10 including at least one, and in one example, two, integrated securement elements 12. Hanger 10 includes a hook 20, a neck region 22, a shoulder region 24, and a pair of arms 26, according to one embodiment of the present invention. Hook 20 is curvilinear and defines an opening 34 at one side, opposite neck region 22, to receive a support rod 30 (see, e.g., FIGS. 9, 10, and 17). Hook 20 extends from a free hook end 32 to a neck region 22, which extends downwardly from hook 20 to a shoulder region 24. In one example, hook 20, neck region 22, and shoulder region 24 are collectively formed of a primary, planar panel 40. Perimeter flanges 42 extend substantially around a perimeter thereof, at least to one of the front side and the back side of the planar panel 40 adding rigidity to hook 20, neck region 22, and shoulder region 24 generally without adding unnecessary material or weight to hanger 10. In one example, perimeter flange 42 also extends inwardly from an outer perimeter of hook 20 to define a non-flanged portion 44 of hook 20 for receiving a separate indicator 46, such as a size indicator, branding indicator, etc. A recess 48 is defined between perimeter flange 42 and a top panel 58 of the pair of arms 26 on at least one side of planar panel 40, at least in one embodiment.

Each of the pair of arms 26 extends downwardly and outwardly away from shoulder region 24 in a symmetrical manner relative to one another to corresponding free arm ends 36. Each of pair of arms 26 intersects one another at an apex or vertex 50, which, in one example, is centered relative to shoulder regions 24. In one embodiment, each of the pair of arms 26 extends away from shoulder region 24 with a substantially linear orientation while, in other embodiments, each of the pair of arms 26 extends away from shoulder region 24 with a curved or otherwise sloped orientation. The pair of arms 26 are sized and shaped to support garments configured to be work on the top of a body, in one embodiment.

As illustrated with primary reference to FIGS. 1, 2, 7, and 8, in one embodiment, the pair or arms 26 are formed via a pair of primary panels 52, for example, a front or first panel 54 and a rear or second panel 56. First panel 54 and second panel 56 are spaced from each other and parallel to one another, in one embodiment. First panel 54 and second panel 56 may have substantially identical overall shapes. First panel 54 defines an interior-facing surface, for example, a rear-facing surface 84, and an opposite an exterior-facing surface, for example, a front-facing surface 86, while second panel 56 defines an exterior-facing surface, for example, a rear-facing surface 88 and an interior-facing surface, e.g., a front-facing surface 86. In one embodiment, a single first panel 54 and a single second panel 56 extends from one free arm end 36 to the other while, in other embodiments, each arm 26 is formed of a separate pair of primary panels 52. In addition, while primarily described herein as hanger 10 including the pair of arms 26, in some embodiments, hanger 10 includes a single arm 26 or three or more arms 26.

In one example, a top panel 58 extends between top edges 62 and 72 of first panel 54 and second panel 56, respectively, to cap a top of the pair of arms 26. In one embodiment, pair of arms 26 is open below top panel 58, between rear-facing surface 84 of first panel 54 and front-facing surface 86 of second panel 56, more particularly, at bottom edges 60 and 70 of first panel 54 and second panel 56, respectively. Strengthening ribs 68 may be formed to extend between first panel 54 and second panel 56 to provide additional rigidity and strength to hanger 10 generally without adding undo weight or material to hanger 10.

In one example, two or more protrusions or friction nubs 66 are applied to or molded on top panel 58 near each of free arm end 36. Friction nubs 66 are provided to add friction in a manner decreasing the likelihood that a garment hung on hanger 10 will readily and inadvertently slide off of hanger arms 26. In another embodiment, another or no friction enhancing means is applied to top panel 58.

Figure 2:
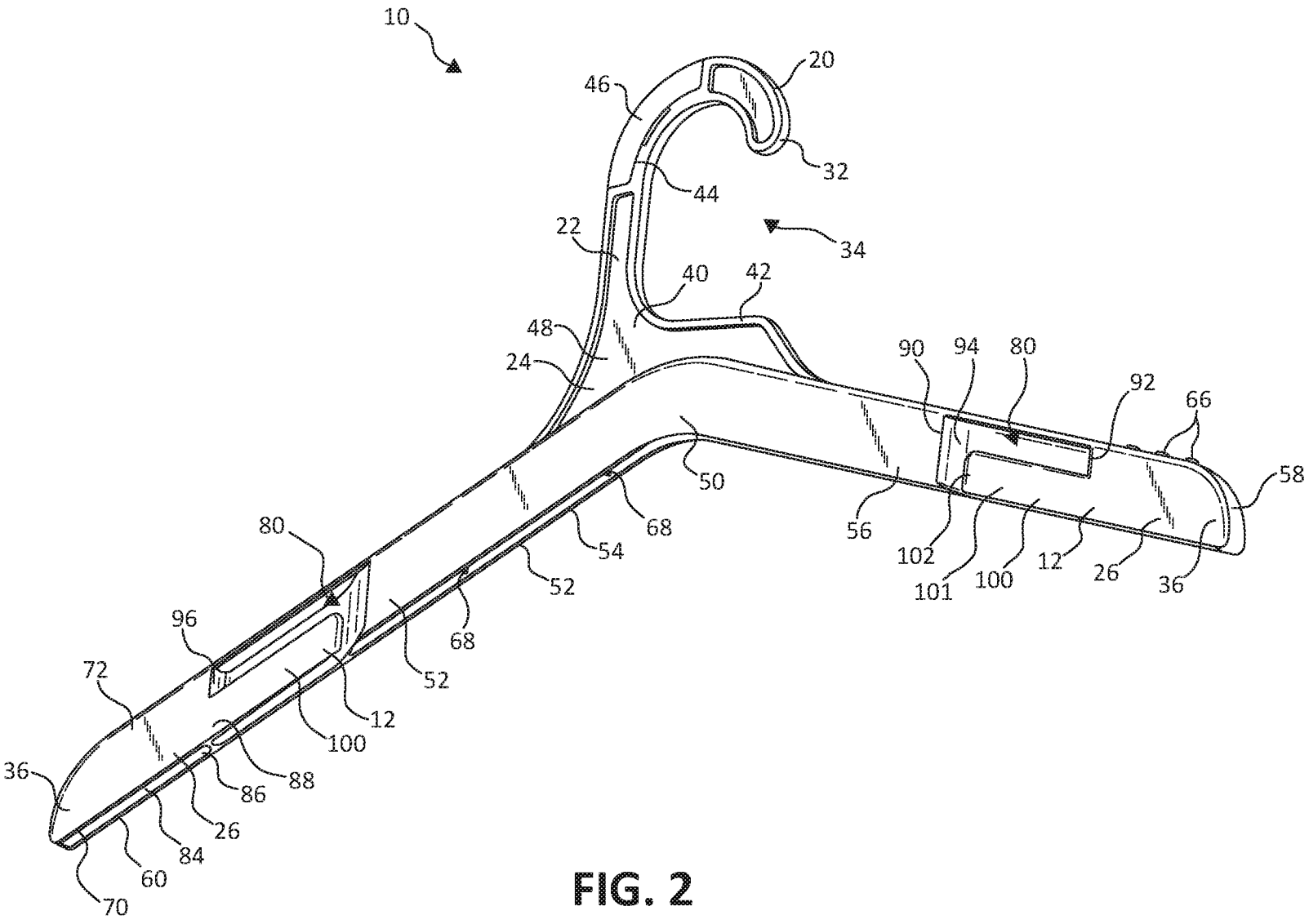
FIG. 2 is a rear perspective view illustration of the hanger of FIG. 1, according to one embodiment of the present invention.
Figure 3:
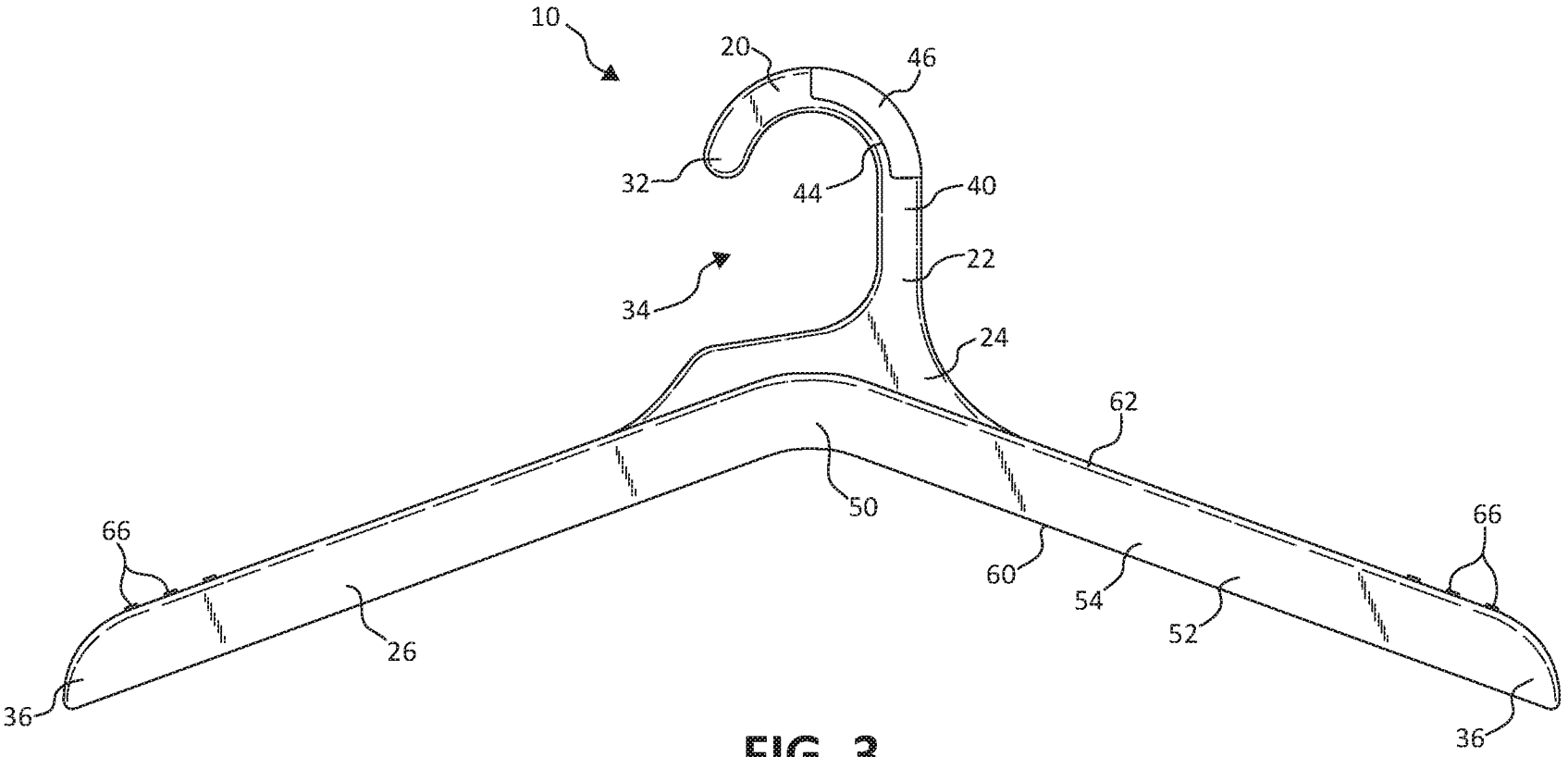
FIG. 3 is a front view illustration of the hanger of FIG. 1, according to one embodiment of the present invention.
Figure 4:
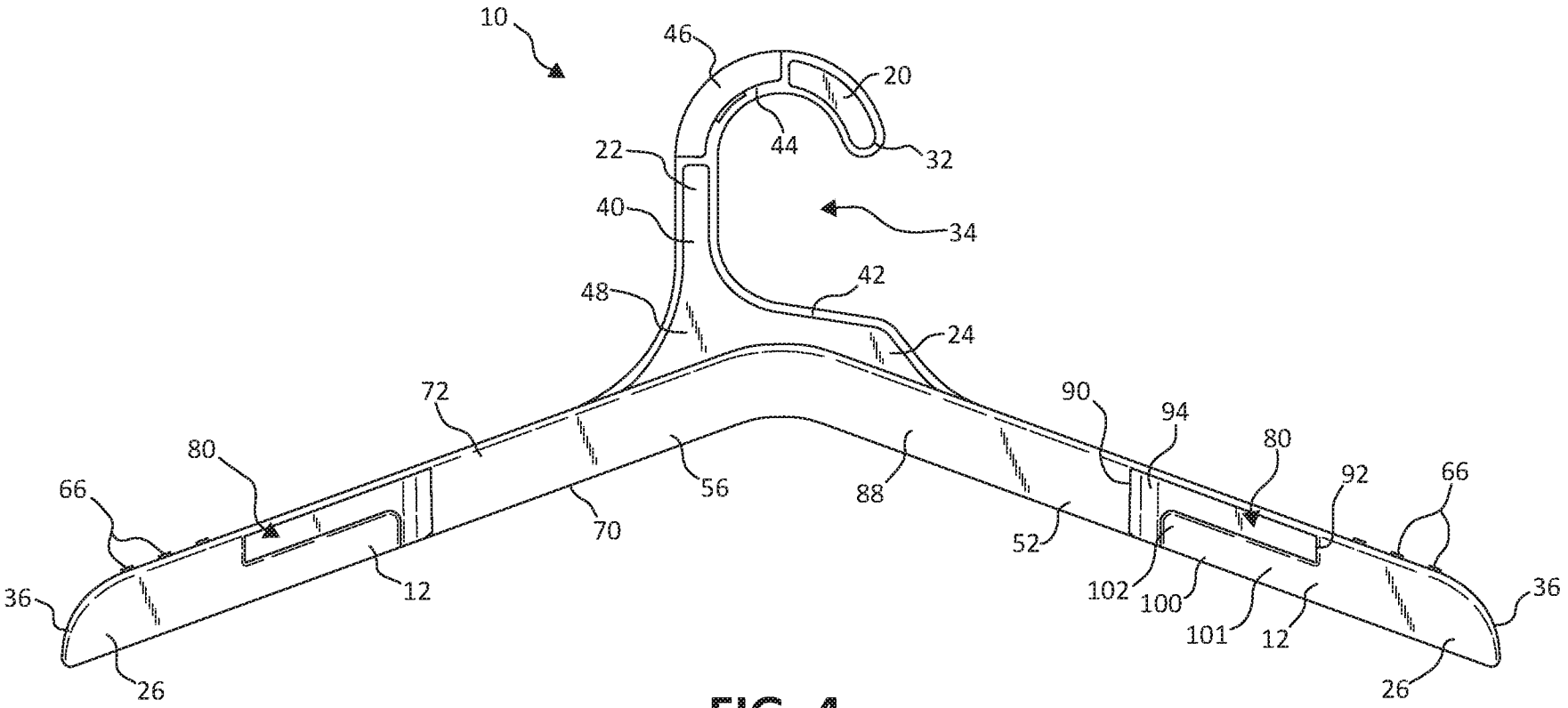
FIG. 4 is a rear-view illustration of the hanger of FIG. 1, according to one embodiment of the present invention.
Figure 6:
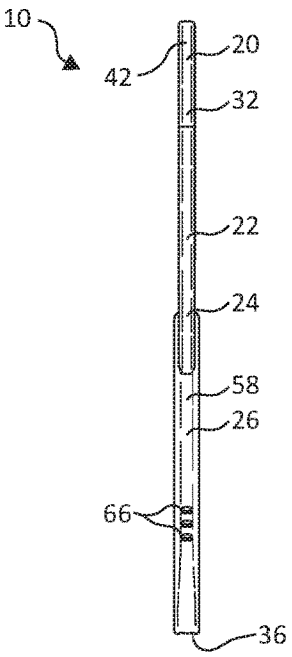
FIG. 6 is a left side view illustration of the hanger of FIG. 1, according to one embodiment of the present invention.
Figure 5:
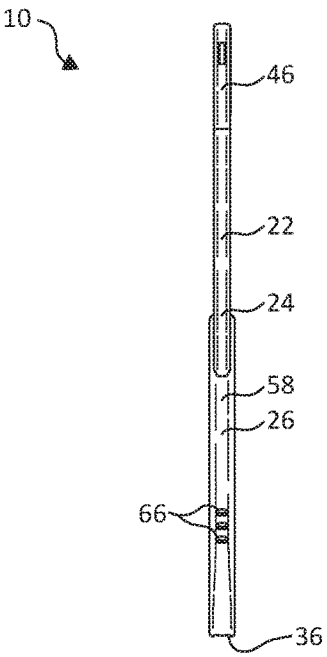
FIG. 5 is a right-side view illustration of the hanger of FIG. 1, according to one embodiment of the present invention.
Figure 7:
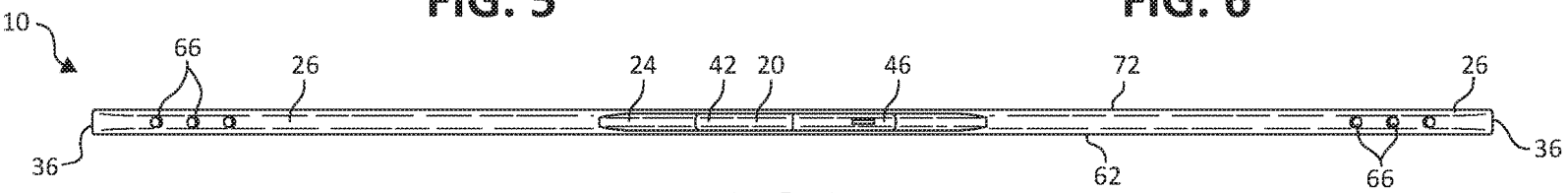
FIG. 7 is a top view illustration of the hanger of FIG. 1, according to one embodiment of the present invention.
Figure 8:
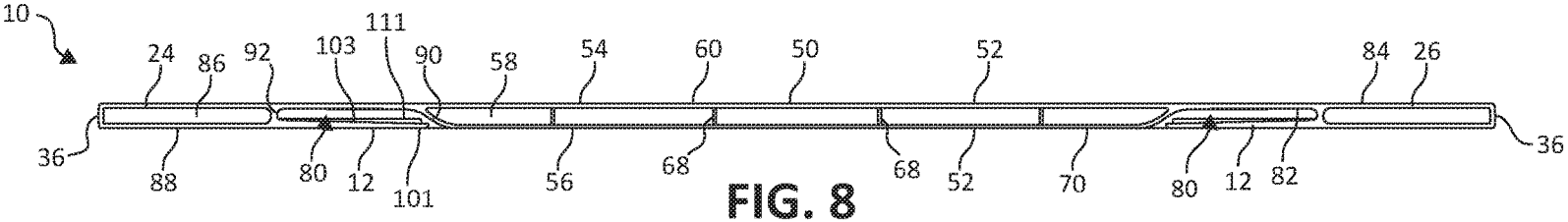
FIG. 8 is a bottom view illustration of the hanger of FIG. 1, according to one embodiment of the present invention.

One of primary panels 52, for example, second panel 56, as illustrated in FIGS. 2, 4, and 8, includes securement element 12, for instance, one securement element 12 on each of the pair of arms 26. One securement element 12 is described below, it being understood, that in one example, a second similar or identical securement element 12 is included on the other one of the pair of arms 26, for instance in a manner substantially symmetrical to the described securement element 12. In this manner, second panel 56 includes an elongated recess or indentation 80 extending along a substantial entirety of a height of second panel 56. Indentation 80 extends from rear-facing surface 88 of second panel 56 forwardly toward, and in one embodiment, to rear-facing surface 84 of first panel 54. Indentation 80 is, in one example, positioned in the outer half of a length of one of the pair of arms 26. In one embodiment, indentation 80 has a length equal to or greater than one-quarter of, in one example, equal to or greater than one-third of, a length of the one or the pair of arms 26.

Indentation 80 extends to bottom edge 70 of second panel 56 toward, and in one embodiment, to top panel 58. An innermost edge 90 of indentation 80 is formed nearest hook 20 while outermost edge 92 of indentation 80 is positioned nearest a corresponding free arm end 36 of one arm 26. Indentation 80 extends from innermost edge 90 toward first panel 54, e.g., forwardly, in a tapered or ramped manner forming a ramped transition wall 94 extending from innermost edge 90 to rear-facing surface 84 of first panel 54, where rear-facing surface 84 also serves as an interior-most surface of indentation 80 in the illustrated embodiment. In another example, while not illustrated, the interior-most surface of indentation 80 is spaced rearwardly from rear-facing surface 84. An outside wall 96 of indentation 80 is formed adjacent rear-facing surface 84 opposite ramped transition wall 94 forming outermost edge 92 of indentation 80.

Each securement element 12 includes an extension, such as a finger 100 extending from outermost edge 92 of indentation over indentation 80 in a cantilevered manner, spaced from rear-facing surface 84 or other interior-most surface of indentation 80. In one embodiment, finger 100 extends toward, but not entirely to, innermost edge 90 to form a free finger end 102 of finger 100 nearest innermost edge 90. Finger 100 defines an exterior surface 101 and an opposing interior surface 103 each being spaced from rear-facing surface 84 of first panel 54. In one example, exterior surface 101 of finger 100 extends substantially, for example, entirely, coplanarly with rear-facing surface 88 of second panel 56 as an extension thereof. Finger 100 has a height that less than about three-quarters of an overall height of the corresponding one of arms 26. In this manner, in one embodiment, indentation 80 is open to a rear of hanger 10 above indentation 80 and below top panel 58 and is slightly open to rear of hanger 10 between free finger end 102 and innermost edge 90 of indentation 80.

In one embodiment, finger 100 has a bottom edge 106 that is substantially collinear with bottom edge 70 of second panel 56 and extends upwardly therefrom toward, but not to, top panel 58 to define a top edge 108 of finger 100 spaced downwardly from top panel 58. Finger 100 has a length, defined from outermost edge 92 to free finger end 102 of finger 100, which is just short of an overall length of indentation 80, as illustrated, for example, in FIG. 8. Any gap formed between free finger end 102 of finger 100 and ramped transition wall 94 is large enough to allow at least a layer of garment 120 (see FIGS. 9, 10, and 17) to be slid therebetween into a space between finger 100 and rear-facing surface 84 in indentation 80, but small enough to generally limit inadvertent movement of that same garment 120 out of indentation 80.

Figure 11:
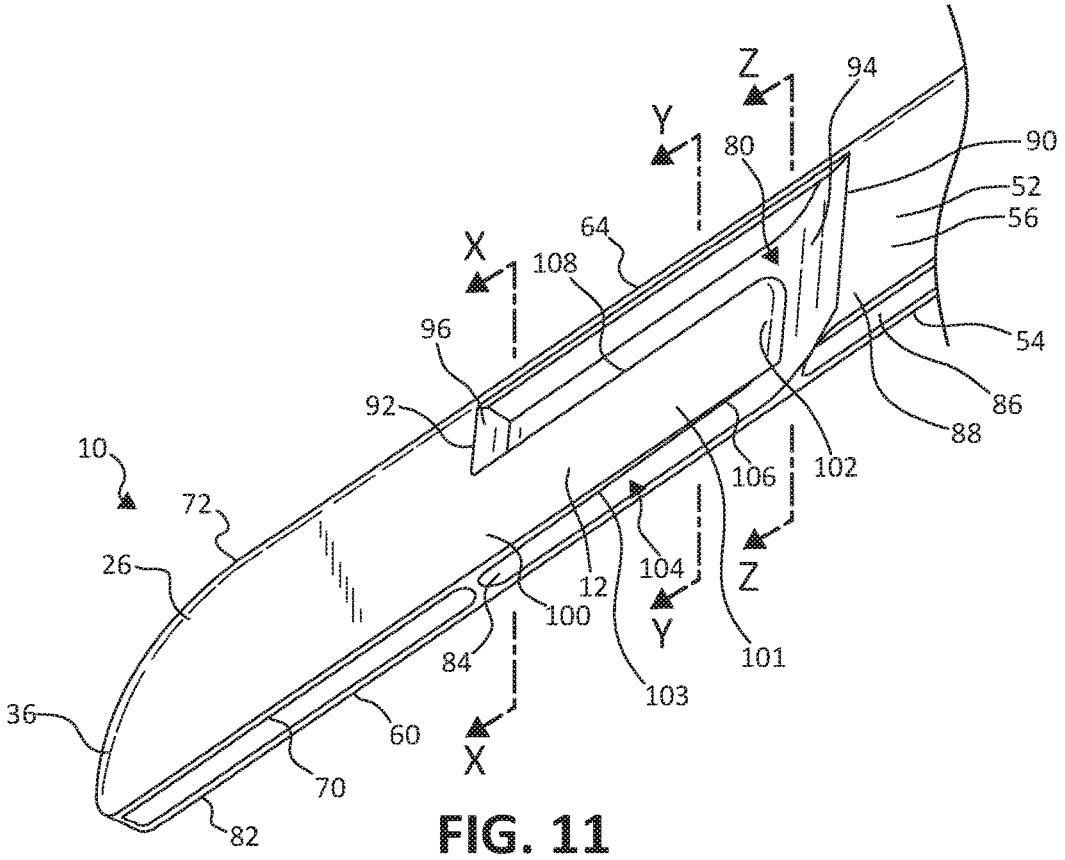
FIG. 11 is a detail view of a portion of the bottom perspective view of the hanger of FIG. 2, according to one embodiment of the present invention.

In one embodiment, finger 100 is formed with an overall material thickness similar to second panel 56 near outermost edge 92 that tapers to a smaller thickness as finger 100 extends to free finger end 102 of finger 100, as more clearly shown with additional reference to FIG. 11 and the corresponding progressive cross-sections of FIGS. 13-15. For example, finger 100 is thickest near outermost edge 92 as shown in FIG. 13, such that distance 104 between finger 100 and rear-facing surface 84 gradually decreases, from distance 104*a* in FIG. 13, to distance 104*b* in FIG. 14, to distance 104*c* in FIG. 15, as finger extends to free finger end 102.

Figure 12:
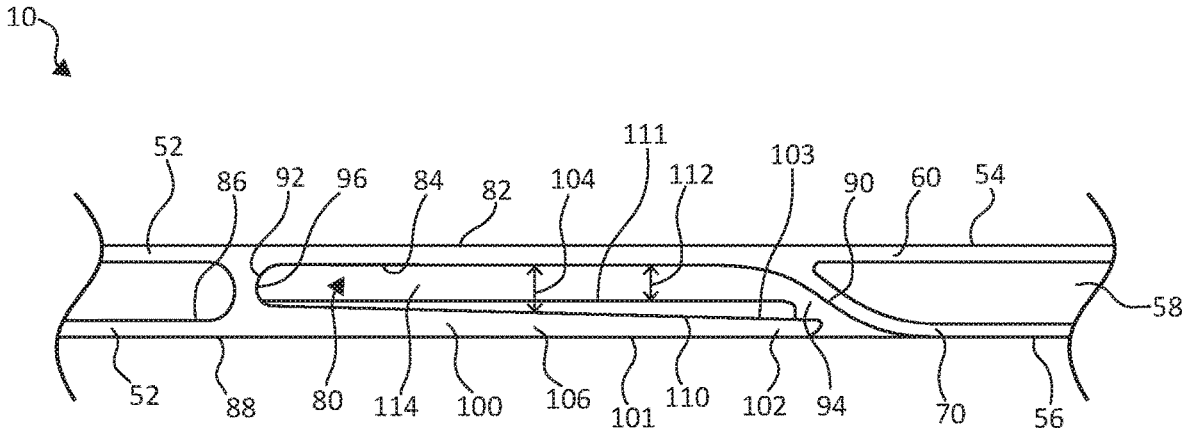
FIG. 12 is a detail view of a portion of the bottom view illustration of the hanger of FIG. 4, according to one embodiment of the present invention.

In one example, finger 100 additionally defines an elongated or finger rib 110 extending along a substantial entirety of a length of finger 100 along top edge 108 thereof. Finger rib 110 extends rearwardly from top edge 108 toward, but not to rear-facing surface 84 of first panel 54. In one example, a thickness of finger rib 110, that is, a distance finger rib 110 extends away from a remainder of finger 100, increases from near outermost edge 92 of indentation 80 toward free finger end 102 of finger 100, as most easily seen in the enlarged portion of a bottom view in FIG. 12 and the progression of cross-sectional views FIGS. 13-15. In one example, the increasing thickness of finger rib 110 from outermost edge 92 to free finger end 102 is substantially equal to the decreasing thickness of finger 100 from outermost edge 92 to free finger end 102 such that a distance 112 between finger rib 110 and rear-facing surface 84 remains substantially consistent. In this manner, in one example, a distance 104 (FIG. 12) between finger 100 and rear-facing surface 84, or other interior-most surface of indentation 80, increases as finger 100 extends to free finger end 102 as shown via distances 104*a*, 104*b*, and 104*c* in FIGS. 13-15. In one example, where finger rib 104 increases in thickness as finger 100 decreases in thickness, a distance 112 between finger rib 104 and rear-facing surface 84, or other interior-most surface of indentation 80, remains consistent along a substantial entirety of a length of finger 100.

Figure 10:
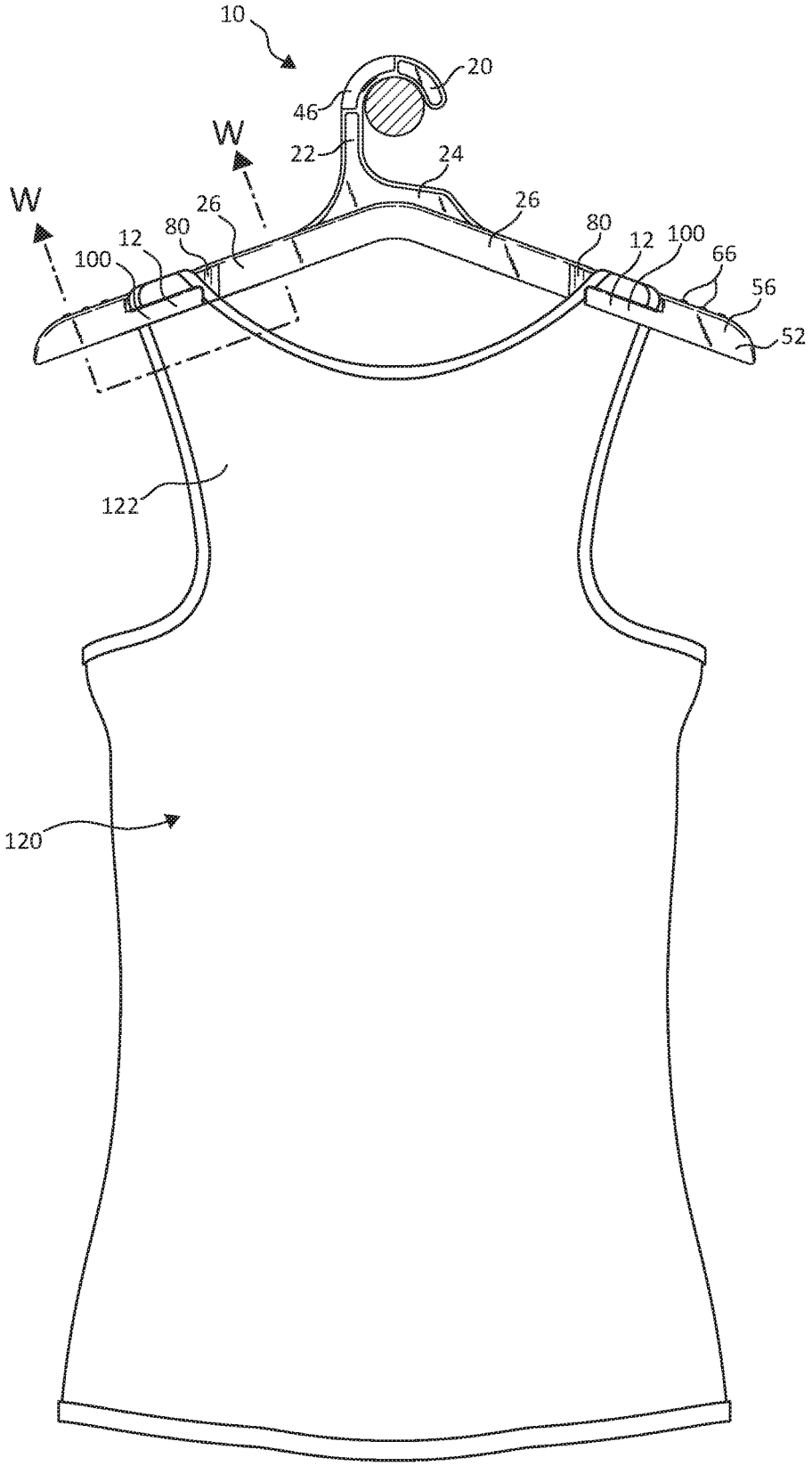
FIG. 10 is a rear perspective view illustration of the hanger and garment of FIG. 9, according to one embodiment of the present invention.

In one example, finger 100 is molded as a single piece with a remainder of the corresponding one of the pair of arms 26. In this manner, finger 100 is biased to remain substantially in-plane with second panel 56. This biasing allows finger 100 to flex slightly to receive garment 120, but to return to its original coplanar positioning with second panel 56 to maintain garment 120 at least partially within indentation 80. More specifically, referring to FIGS. 9, 10, and 16, garment 120 is placed on hanger 10 such that hook 20 extends out a neck hole of garment 120 placing a strap 122 or other similar portion of garment 120 over one of arms 26. When so positioned or while so positioning garment 120 on hanger 10, a rear part of strap 122 or other suitable portion of garment 120 is slid into indentation 80. For example, as shown in FIGS. 10 and 16, a back of strap 122 is slid into indentation 80 through a gap between free finger end 102 and ramped transition wall 94. In one example, the sliding of garment 120 into indentation 80 is eased by the ramped configuration of ramped transition surface 90.

Once strap 122 is fully positioned within indentation 80, it is snugly, but not constrictively, held in indentation 80 via compression between finger 100 and rear-facing surface 84 and/or friction from finger 100. On one example, finger rib 110 provides an additional line of interaction with or grip to strap 122 to more snugly hold strap 122 in indentation 80. Since finger rib 110 is relatively small in height as compared to finger 100, finger rib 110 does not exert as much friction on strap 122 as finger rib 110 would if sized the full height of finger 100 to still allow strap 122 to be fairly easily removed from indentation 80 when desired by a user. In addition, the relatively small height of finger rib 110 also does not overly stiffen finger 100 to decrease the ability of finger 100 to flex slightly when allowing strap to be moved into and out of indentation 80. When garment 120 is so placed in indentation, a lower portion of strap 122 extends out of indentation 80 through the opening between first panel 54 and second panel 56. Interaction between finger 100, e.g., finger rib 110, and strap 122 generally serve to maintain garment 120 on hanger and strap 122 in indentation 80 even during inadvertent rotation of other movement of garment 120 relative to hanger 10 and/or of garment 120 and hanger 10 relative to a support rod, as shown for example in FIG. 17, during consumer perusal of garment 120 while hung on the support rod.

Since indentation 80 and finger 100, i.e., securement element 12, are placed on within a second panel 56 of hanger 10, securement element 12 is not aesthetically distracting from the presentation of garment 120 on hanger 10. In addition, placement of securement element 12 within second panel 56 allows top edges 62 and 72 of first and second panels 54 and 56 to also be used to maintain garment 120 on hanger 10. More specifically, with strap 122 gripped in indentation 80, garment 120 is pulled tighter against top edges 62 and 72, thereby, providing additional securement of garment 120 on hanger 10 without providing additional obstacles to removing garment 120 from hanger 10 when eventually desired. As such, the proposed positioning of securement element provides both aesthetic and functional benefits and advancements.

FIGS. 18-21 illustrate various views of a hanger 210 including at least one, and in one example, two, integrated securement elements 212. Hanger 210 includes hook 20, neck region 22, a shoulder region 24, which are all substantially identical to similar component of hanger 10. Hanger 210 additionally includes a pair of arms 226, according to one embodiment of the present invention, each extending outwardly away from shoulder region 24 in a symmetrical manner relative to one another to corresponding free arm ends 236. Each of pair of arms 226 intersects one another at a vertex 250, which, in one example, is centered relative to shoulder region 24. In one embodiment, each of the pair of arms 226 extends away from shoulder region 24 with a substantially linear orientation, for example, a substantially horizontal orientation when hanger 210 is hung via hook 20 such that vertex 250 is a substantial center point of a collectively linear extension of the pair of arms 226 between two free arm ends 236. In one embodiment, pair of arms 226 appears similar to a single, substantially linear arm, extending outwardly along each of two sides of hook 20. In other embodiments, each of the pair of arms 226 extends away from shoulder region 24 with a curved or otherwise sloped orientation. The pair of arms 226 are sized and shaped to support various garments configured to be worn by a user and/or includes additional features to maintain one or more garments. For example, clamps 238 such as clips, or other grasping members may be included along the length of each pair of arms 226 and/or at each of free arm ends 236. In one embodiment, no clamps. 238 are included on hanger 210.

As illustrated, in one embodiment, the pair or arms 226 are formed via a front or first panel 254. First panel 254 defines an interior-facing surface, for example, a rear-facing surface 284, and an opposite an exterior-facing surface, for example, a front-facing surface 286. In one embodiment, a single first panel 254 extends from one free arm end 236 to the other while, in other embodiments, each arm 226 is formed of a separate first panel 254. In addition, while primarily described herein as hanger 210 including the pair of arms 226 extending substantially colinearly with each other, in some embodiments, hanger 210 includes a single arm 226 or three or more arms 226 at various orientations relative to each other.

In one example, a top panel 258 extends rewardly from a top edge 262 of first panel 54 to cap a top of the pair of arms 226. In one example, a bottom panel 260 extends rewardly from a bottom edge 264 of top panel 258 substantially parallel to top panel 258. In one embodiment, pair of arms 226 is substantially between top panel 258 and bottom panel 260 and/or behind rear-facing surface 284 of first panel 254. Strengthening ribs 268 may be formed provide additional rigidity and strength to hanger 10 generally without adding undo weight or material to hanger 10 and may extend between top panel 258, bottom panel 260, and/or first panel 54 as desired.

In one embodiment, a securement element 212, is defined opposite first panel 254, for example as a partial second panel 256, spaced downwardly from top panel 258. For instance, one securement element 212 is defined on each of the pair of arms 226. One securement element 212 is described below, it being understood, that in one example, a second similar or identical securement element 212 is included on the other one of the pair of arms 226, for instance in a manner substantially symmetrical to the described securement element 212. In one embodiment, bottom panel 260 ceases to extend along a length of each of the pair of arms 226 at locations adjacent securement element 212 forming an indentation 280 or recessed area below top panel 258 and between first panel 254 and securement elements 212. Indentation 280 is, in one example, positioned in the outer half of a length of one of the pair of arms 226. In one embodiment, indentation 280 has a length equal to or greater than one-quarter of, in one example, equal to or greater than one-third of, a length of the one of the pair of arms 226.

An innermost edge 290 of indentation 280 is formed nearest hook 20 while an outermost edge 292 of indentation 280 is positioned nearest a corresponding free arm end 236 of one of the pair or arms 226. Indentation 80 extends from outermost edge 292 toward first panel 254, e.g., forwardly, in a tapered or ramped manner forming a ramped transition wall 294 extending from outermost edge 292 to rear-facing surface 284 of first panel 254, where rear-facing surface 284 also serves as an interior-most surface of indentation 280 in the illustrated embodiment. In another example, while not illustrated, the interior-most surface of indentation 280 is spaced rearwardly from rear-facing surface 284. An outside wall 296 of indentation 80 is formed adjacent rear-facing surface 284 opposite ramped transition wall 294 forming innermost edge 290 of indentation 280.

Each securement element 212 includes an extension, such as a finger 300 extending from innermost edge 290 of indentation over indentation 280 in a cantilevered manner, spaced from rear-facing surface 284 or other interior-most surface of indentation 280. In one embodiment, finger 300 extends toward, but not entirely to, outermost edge 92 to form a free finger end 302 of finger 300 nearest outermost edge 292. Finger 300 defines an exterior surface 301 and an opposing interior surface 303 each being spaced from rear-facing surface 284 of first panel 254. In one example, exterior surface 301 of finger 300 extends substantially, for example, entirely, parallel to front-facing surface 286 of first panel 254. Finger 300 has a height that less than about three-quarters of an overall height of the corresponding one of arms 226. In this manner, in one embodiment, indentation 280 is open to a rear of hanger 210 above finger 300 and below top panel 258 and is slightly open to rear of hanger 210 between free finger end 302 and innermost edge 290 of indentation 280.

In one embodiment, finger 300 has a bottom edge 306 that is substantially coplanar with bottom edge 264 of first panel 254 and extends upwardly therefrom toward, but not to, top panel 258 to define a top edge 308 of finger 300 spaced downwardly from top panel 258. Finger 300 has a length, defined from an innermost edge 290 of indentation 280 to free finger end 302 of finger 300, which is short of an overall length of indentation 280, as illustrated, for example, in FIGS. 20 and 21. Any gap formed between free finger end 302 of finger 300 and ramped transition wall 294 is large enough to allow at least a layer of garment 120 (see FIGS. 9, 10, and 17) to be slid therebetween into a space between finger 300 and rear-facing surface 284 in indentation 280, but small enough to generally limit inadvertent movement of that same garment 120 out of indentation 280 in a manner similar to that described in detail above with respect to hanger 10.

Figure 21:
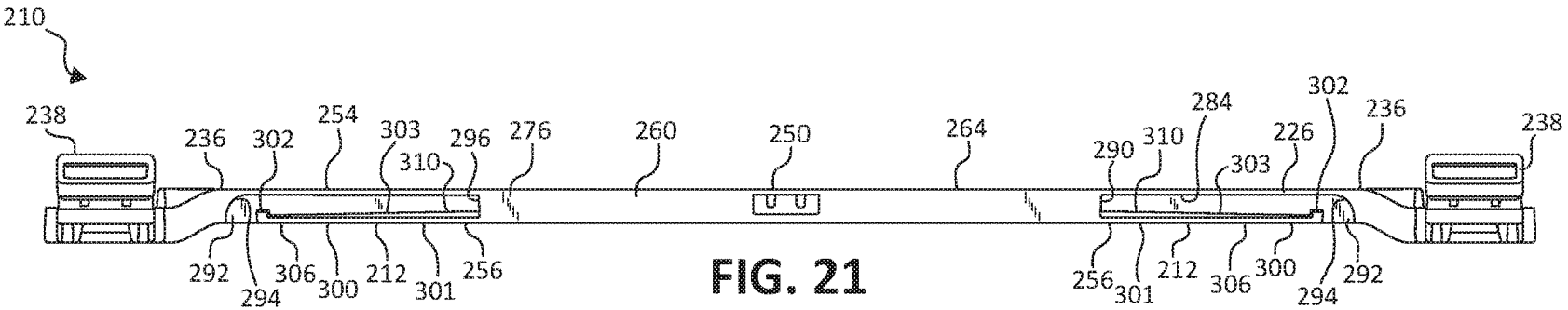
FIG. 21 is a bottom view illustration of the hanger of FIG. 18, according to one embodiment of the present invention.

In one embodiment, finger 300 is formed with an overall material thickness that tapers to a smaller thickness as finger 300 extends to free finger end 302 of finger 300, as more clearly shown with additional reference to FIG. 21 similar to the taper described in detail with regards to finger 100 above. For example, finger 300 is thickest near innermost edge 290 of indentation, such that a distance between finger 300 and rear-facing surface 284 gradually decreases as finger extends to free finger end 302.

In one example, finger 300 additionally defines an elongated or finger rib 310 extending along a substantial entirety of a length of finger 300 along top edge 308 thereof similar to figure rig 110 described in detail above. Finger rib 310 extends rearwardly from top edge 308 toward, but not to rear-facing surface 284 of first panel 254. In one example, a thickness of finger rib 310, that is, a distance finger rib 310 extends away from a remainder of finger 300, increases from near outermost edge 292 of indentation 280 toward free finger end 302 of finger 300. In one example, the increasing thickness of finger rib 310 from outermost edge 292 to free finger end 302 is substantially equal to the decreasing thickness of finger 300 from outermost edge 292 to free finger end 302 such that a distance between finger rib 310 and rear-facing surface 284 remains substantially consistent along a substantial entirety of a length of finger 300.

In one example, finger 300 is molded as a single piece with a remainder of the corresponding one of the pair of arms 226. In this manner, finger 300 is biased to remain substantially in-plane with second panel 256. This biasing allows finger 300 to flex slightly to receive garment 120 as described with respect to hanger 10 (see FIGS. 16 and 17), but to return to its original coplanar positioning with second panel 256 to maintain garment 120 at least partially within indentation 280. While garment 120 is shown as a tank top, it should be understood that garment 120 can be any other clothing item, accessory, etc. having a portion thereof flexible enough to be maintained by finger 300.

As describe in the embodiments above, this innovation provides a hanger having one or more integrated securement elements to facilitate maintaining garments on the hanger. In one embodiment, the hanger includes one or more arms, where at least one of those arms defines an indentation or recess extending from one of the front-facing surface and the rear-facing surface toward the other. A finger or cantilevered protrusion element extends from one side of the indentation toward, but not to, the other side of the indentation forming a slot for receiving a portion of a garment in a manner configured to hold the garment to the hanger. The securement element is formed on one of the front-facing or rear-facing surfaces provides an aesthetic appeal, as the finger does not distract from the overall aesthetic form of the hanger. The securement element is formed on one of the front-facing or rear-facing surfaces also provides functional advantages by allowing the garment to separately, yet, in one embodiment, more tightly, interact with top surfaces of the hanger and protecting against inadvertent release of garment from the securement element.

Although the invention has been described with respect to particular embodiments, such embodiments are meant for illustrative purposes only and should not be considered to limit the invention. Various alternatives and changes will be apparent to those of ordinary skill in the art upon reading this application. Other modifications within the scope of the invention and its various embodiments will be apparent to those of ordinary skill.

What is claimed is:

1. A garment hanger comprising:

a hook configured to selectively receive a support rod;

an arm coupled to the hook and extending outwardly to a free arm end, wherein the arm includes:

a first substantially planar panel facing toward one of a front and a rear of the garment hanger, a top panel extending rearwardly from a top edge of the first substantially planar panel, an indentation defined adjacent the first substantially planar panel and below the top panel to be at least partially open in a direction facing away from the first substantially planar panel, the indentation defining an outermost edge nearest the free arm end and an innermost edge nearest the hook, and a finger extending from one of the outermost edge and the innermost edge of the indentation toward the other one of the outermost edge and the innermost edge of the indentation and being configured to hold a portion of a garment within the indentation, wherein the finger is formed adjacent the indentation opposite the first substantially planar panel, wherein the arm including the first substantially planar panel and the finger is molded as a single, static piece.

2. The garment hanger of claim 1, wherein the finger defines an exterior-facing surface opposite the indentation, and the exterior-facing surface is substantially parallel with an exterior-facing surface of the first substantially planar panel.

3. The garment hanger of claim 1, wherein the finger extends from the one of the outermost edge and the innermost edge of the indentation with a decreasing thickness to a free finger end nearest the other one of the outermost edge and the innermost edge of the indentation.

4. The garment hanger of claim 1, further comprising a finger rib extending from a top edge of the finger toward the first substantially planar panel to enhancing gripping of the garment maintained within the indentation via the finger, wherein the finger rib and the finger are formed as a single molded piece.

5. The garment hanger of claim 4, wherein finger extends from the one of the outermost edge and the innermost edge of the indentation with a decreasing thickness to a free finger end nearest the other one of the outermost edge and the innermost edge of the indentation.

6. The garment hanger of claim 1, wherein a second substantially planar panel is defined opposite to and spaced from the first substantially planar panel, and the finger is formed substantially coplanarly with the second substantially planar panel.

7. The garment hanger of claim 1, wherein the indentation is immediately adjacent the top panel.

8. The garment hanger of claim 7, wherein the indentation is open between a top edge of the finger and the top panel.

9. The garment hanger of claim 1, wherein the indentation extends to a bottom edge of the arm.

10. The garment hanger of claim 9, wherein the finger defines a bottom edge positioned a distance from the top panel that is no greater than a distance between the top panel and a bottommost edge of the first substantially planar panel.

11. The garment hanger of claim 1, wherein:

the arm is a first arm of the pair of arms, the indentation and the finger are a first indentation and a first finger, and the garment hanger includes a second finger and a second indentation on a second arm of the pair of arms.

12. The garment hanger of claim 1, wherein the finger extends from the outermost edge of the indentation toward the innermost edge of the indentation.

13. The garment hanger of claim 11, further comprising a neck region and a shoulder region, wherein the hook is coupled to the pair of arms via the neck region and the shoulder region of the garment hanger.

14. A garment hanger comprising:

a hook, a shoulder region coupled to the hook, a pair of arms each extending in an opposite direction relative to the shoulder region to a free arm end, and the first arm of the pair of arms being formed as a single molded piece of material including a securement element, wherein:

the first arm of the pair of arms defines a front-facing, substantially planar surface, the securement element includes:

a recess rearwardly extending away from the front-facing, substantially planar surface, and a cantilevered protrusion element extending from one side of the recess, opposite the front facing, substantially planar surface, toward the other side of the recess to form a slot for receiving a garment within the recess wherein the cantilevered protrusion element facilitates maintenance of the garment within the recess behind the front facing, substantially planar surface.

15. The garment hanger of claim 14, wherein the cantilevered protrusion element defines a front surface substantially parallel with the front-facing, substantially planar surface.

16. The garment hanger of claim 14, further comprising an elongated rib extending from a top edge of the cantilevered protrusion element toward the front-facing, substantially planar surface to enhance gripping of the garment maintained within the recess via the cantilevered protrusion element.

17. The garment hanger of claim 14, wherein the recess defines an outermost edge nearest the free arm end, and the cantilevered protrusion element extends from the outermost edge with a decreasing thickness to a free finger end opposite the outermost edge.

18. The garment hanger of claim 6, wherein the finger is molded as a single piece with at least the second substantially planar panel.

19. The garment hanger of claim 18, wherein the finger extends from the outermost edge of the indentation toward the innermost edge of the indentation.

* * * * *